US010421091B2

(12) United States Patent
Caponegri et al.

(10) Patent No.: US 10,421,091 B2
(45) Date of Patent: Sep. 24, 2019

(54) ACTUATING ASSEMBLY FOR A SYSTEM FOR DISPENSING A PRODUCT UNDER PRESSURE

(71) Applicant: Natura Cosméticos S.A., São Paulo (BR)

(72) Inventors: Rafael Aparecido Caponegri, Itapecerica da Serra (BR); Reginaldo Francisquetti, Jundiaí (BR); Edenilson Aldo Fadel, Jundiaí (BR)

(73) Assignee: Natura Cosméticos S.A., São Paulo (BR)

( * ) Notice: Subject to any disclaimer, the term of this patent is extended or adjusted under 35 U.S.C. 154(b) by 0 days.

(21) Appl. No.: 15/800,633

(22) Filed: Nov. 1, 2017

(65) Prior Publication Data

US 2018/0133734 A1 May 17, 2018

(30) Foreign Application Priority Data

Nov. 17, 2016 (BR) ..... 102016026965

(51) Int. Cl.
*B05B 11/00* (2006.01)
*B05B 15/30* (2018.01)
(Continued)

(52) U.S. Cl.
CPC ..... *B05B 11/3052* (2013.01); *B05B 11/0027* (2013.01); *B05B 11/0037* (2013.01);
(Continued)

(58) Field of Classification Search
CPC . B05B 11/3052; B05B 11/0027; B05B 15/30; B05B 11/0037; B65D 83/205; B65D 83/22
See application file for complete search history.

(56) References Cited

U.S. PATENT DOCUMENTS 4,865,230 A * 9/1989 Tugwood ..... B05B 11/0005 222/383.3
8,695,852 B2 * 4/2014 Bertin ..... B05B 11/0032 222/153.13

(Continued)

FOREIGN PATENT DOCUMENTS

CN 103723383 A 4/2014
DE 10 2010 011761 A1 9/2011
WO WO 01/53157 * 12/2001 ..... B65D 83/205

*Primary Examiner* — David P Angwin
*Assistant Examiner* — Bob Zadeh
(74) *Attorney, Agent, or Firm* — Alston & Bird LLP

(57) ABSTRACT

An actuating assembly for dispensing a product under pressure is provided, which includes a shoulder mounted on a device for sampling the product under pressure, and a button with an inner actuator having a upstream spout mounted in a feeding tube and a downstream spout in communication with the upstream spout which terminates in a dispensing outlet, wherein the button has an outer cover with a peripheral skirt and a dispensing hole, and wherein the outer cover is mounted on the actuator in a actuating position in which the hole is arranged opposite the outlet to allow the product to be dispensed through the hole. The button is also axially displaceable with respect to the shoulder in a dispensing and aspiration stroke, and the cover is reversibly mounted on the actuator from an actuating to an inactive position and is arranged in order to prevent axial displacement of the button.

20 Claims, 5 Drawing Sheets

(51) Int. Cl.
*B65D 83/20* (2006.01)
*B65D 83/22* (2006.01)

(52) U.S. Cl.
CPC ..... *B05B 15/30* (2018.02); *B65D 83/205* (2013.01); *B65D 83/22* (2013.01)

(56) References Cited

U.S. PATENT DOCUMENTS

| | | | | |
|---|---|---|---|---|
| 9,394,096 | B2 * | 7/2016 | Betts | B65D 83/205 |
| 2004/0089741 | A1 * | 5/2004 | Mathiez | A45D 34/02 239/302 |
| 2008/0023498 | A1 * | 1/2008 | Bertin | B05B 11/0032 222/402.12 |
| 2014/0161506 | A1 * | 6/2014 | Bloc | A45D 34/04 401/176 |
| 2017/0247174 | A1 * | 8/2017 | Furner | A01M 7/0003 |
| 2018/0133734 | A1 * | 5/2018 | Caponegri | B05B 11/0027 |

* cited by examiner

ACTUATING ASSEMBLY FOR A SYSTEM FOR DISPENSING A PRODUCT UNDER PRESSURE

FIELD OF THE INVENTION

The present invention relates to an actuating assembly for a system for dispensing a product under pressure, to a dispensing system comprising a sample device provided with a pressure feed tube and said actuating assembly, and a bottle comprising a body in which a container for packaging a product is formed and which is equipped with said dispensing system to allow dispensing of said product under pressure.

BACKGROUND OF THE INVENTION

The known actuating assemblies comprise a press button comprising an inner actuator, wherein said inner actuator has an upstream spout wherein a lower end thereof is to be mounted in a feed tube of a device for sampling a product under pressure, for example a pump or a valve. The nozzle assembly further comprises a downstream spout, which is in communication with the upstream spout and terminates in an outlet to dispense the product under pressure.

Further, the press button generally comprises an outer cover comprising a peripheral skirt in which a dispensing hole is formed, wherein said outer cover is mounted on the internal driver in an actuating position in which the dispensing hole is disposed opposite the outlet to allow the product to be dispensed through said dispensing hole.

In addition, there are known actuating assemblies which also comprise a shoulder which comprises a means for mounting it around the sampling device in the feed tube from which the press button is mounted, so that said press button in the actuating position can be displaceable axially with respect to said shoulder.

It is known that such dispensing systems are used to equip a bottle in which a product is conditioned, so as to allow dispensing of said conditioned product by actuating said systems by means of their actuating assemblies. In particular, the outer cover of the press button comprises an upper plate which is disposed on its peripheral skirt and which has an upper region for actuating the dispensing system, especially with the pressure of a finger on said upper zone, by an axial displacement of the press button in a dispensing/aspiration stroke.

When the bottle is not used, it is desirable to prevent axial displacement of the press button, especially when the bottle is stored in a traveling bag so as to prevent any accidental activation of the system, which may not only cause the product to be wasted, but also stain other items in the luggage.

To do so, it is common to provide cover caps, which are arranged to be reversibly mounted on the bottle in such a manner as to cover the press button, and thereby prevent any axial displacement of said press button. Thus, when a user wants to dispense a dose of the product, he should simply remove the cover cap to release the press button.

However, such cover caps are not entirely satisfactory, since their assembly in the bottle is not completely safe. Such cover caps are often attached to the bottle by a slight serrated contact at its lower end, thus they may inadvertently be released from the bottle by any accidental impact.

Furthermore, there are actuating assemblies comprising means for reversibly locking the press button, for example, a lock mounted on the shoulder and displaceable between an open position and a closed position to respectively enable and prevent the axial displacement of the press button with respect to said shoulder.

However, such locking means are also not completely satisfactory, since they are relatively difficult to implement and complicate the production of the actuating assemblies.

SUMMARY OF THE INVENTION

The invention aims to improve the prior art by proposing an actuating assembly for a system for dispensing a product that is easy to produce, said assembly is also arranged to prevent any accidental actuation of said system in a simple and reliable manner.

For this purpose, according to a first aspect, the invention relates to an actuating assembly for a system for dispensing a product under pressure, said assembly comprising a shoulder that comprises a means for mounting it on a device for sampling the product under pressure, said assembly further comprising a press button that comprises an inner actuator having a upstream spout wherein a lower end thereof is to be mounted in a feed tube of the sampling device, said actuator comprising a downstream spout in communication with said upstream spout and terminates in an outlet to dispense the product under pressure, said press button comprises an outer cover that comprises a peripheral skirt in which a dispensing hole is formed, said outer cover is mounted on said inner actuator in a actuating position in which the dispensing hole is arranged opposite the outlet to allow the product to be dispensed through said dispensing hole and wherein the press button is axially displaceable with respect to the shoulder in a dispensing/aspiration stroke, the outer cover is reversibly mounted on the inner actuator from the actuating position to an inactive position, in which the geometric means formed in the outer cover are arranged to cooperate with the complementary geometric means formed in the shoulder, in order to prevent axial displacement of the press button.

In a second aspect, the invention relates to a system for dispensing a product under pressure, which comprises a sampling device provided with a feed tube under pressure of the product, and in such a actuating assembly the shoulder is mounted in the sampling device in such a manner that the feed tube extends outwardly of said shoulder, and the lower end of the upstream spout is mounted in said feed tube to allow the product to be dispensed under pressure.

In a third aspect, the invention relates to a bottle for dispensing a product under pressure, wherein said bottle comprises a body wherein a container for packaging said product is formed, and said body is also equipped with a dispensing system to allow the product to be dispensed under pressure.

BRIEF DESCRIPTION OF THE DRAWINGS

Other aspects and advantages of the invention will be disclosed in the following description with reference to the attached figures, in which.

DETAILED DESCRIPTION OF THE INVENTION

With respect to these figures, it is described below a bottle 1 comprising a container in which a product is to be conditioned, wherein said bottle is equipped with a system for dispensing said conditioned product under pressure. As an example of application, the product to be dispensed under pressure is a perfume, a cosmetic or a pharmaceutical product.

Figure 4:
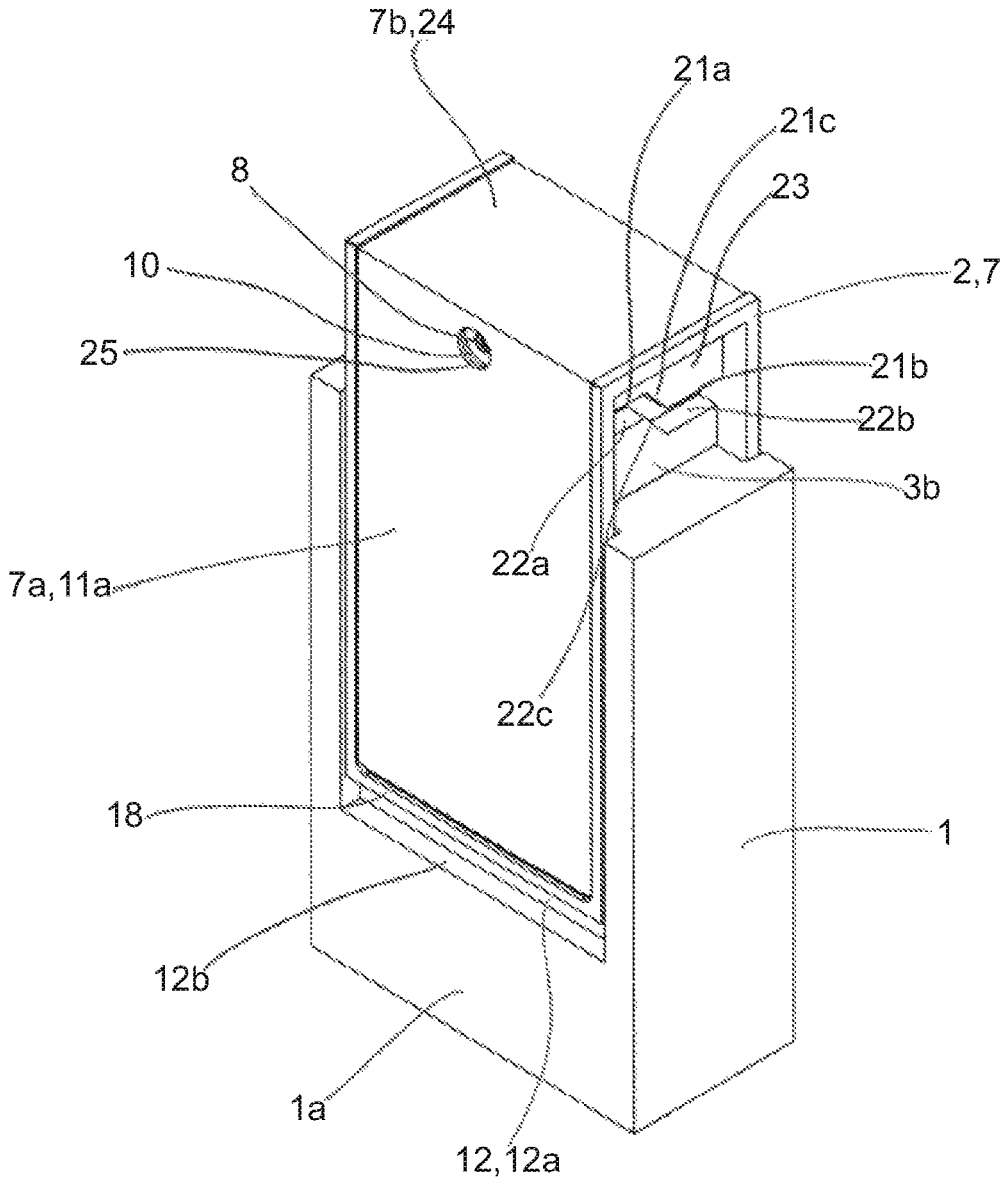
FIG. 4 illustrates in perspective view a bottle equipped with a drive assembly according to FIG. 1, wherein the outer cover is mounted in the actuating position.
Figure 5A:
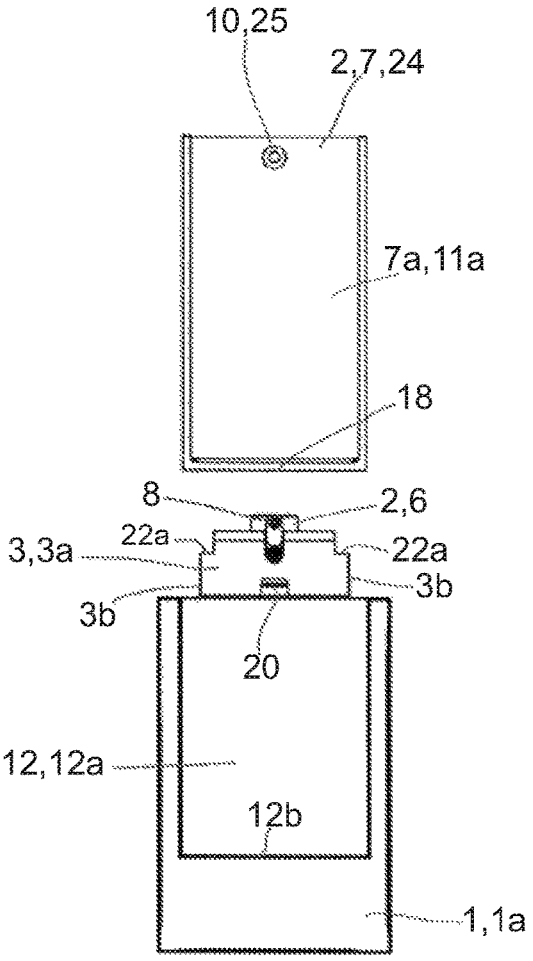
FIG. 5 illustrates the bottle of FIG. 4 during the assembly of the outer cover in the actuating position, respectively in a front view (FIG. 5*a*) and in perspective view (FIG. 5*b*).
Figure 5B:
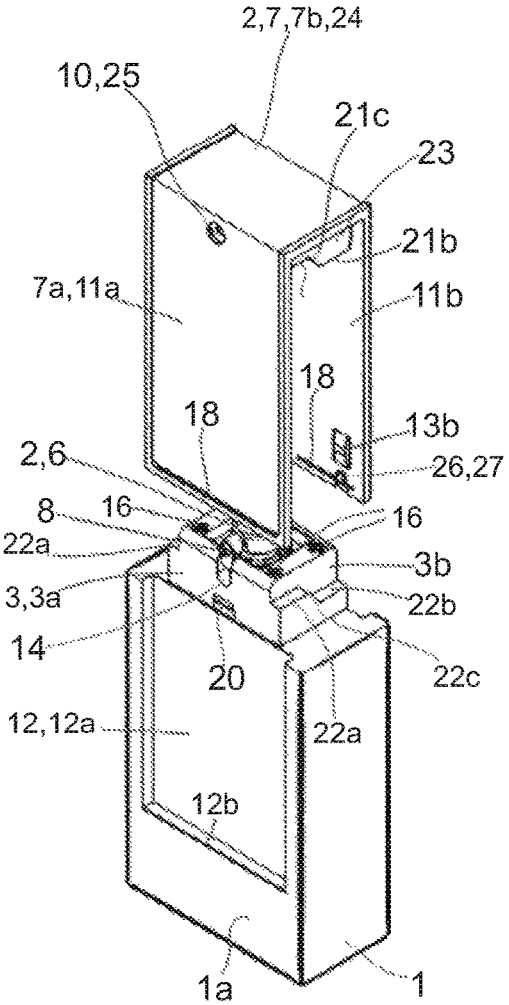
Figure 6A:
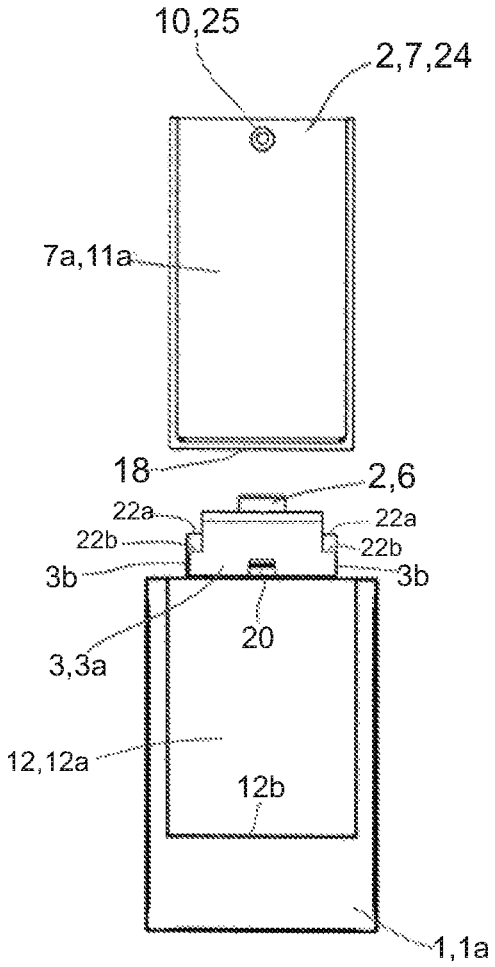
FIG. 6 illustrates the bottle of FIG. 4 during the assembly of the outer cover in the inactive position, respectively in a front view (FIG. 6*a*) and in perspective view (FIG. 6*b*).
Figure 6B:
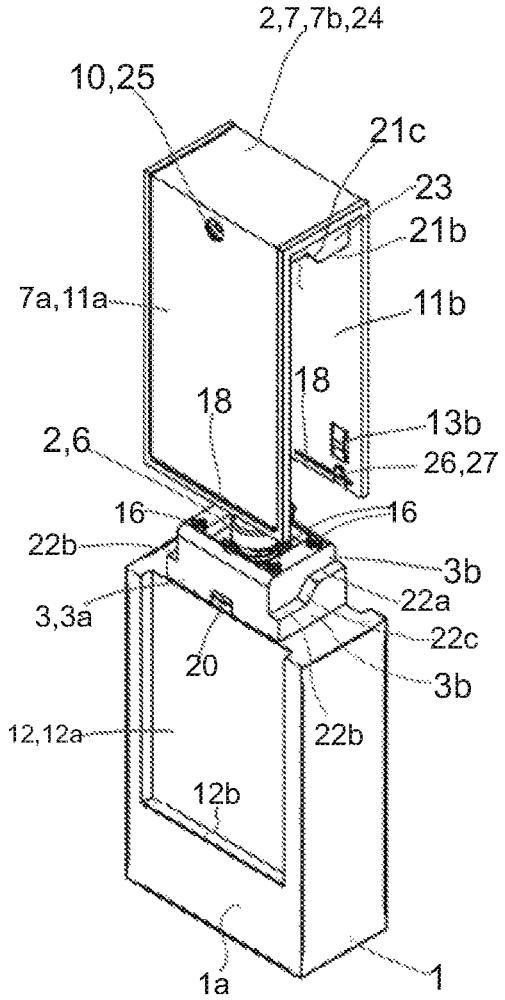

As illustrated in FIGS. 4 to 6, the bottle 1 comprises a body which may be made of a hard material, in particular glass or a plastic, and in which a container is made for the packaging of such product. In particular, the body may be transposed by a neck which is formed in a single piece with said body, and in which the dispensing system must be assembled to allow the product packaged in the container to be dispensed.

The dispensing system comprises a device for sampling the product under pressure. The sampling device may include a manually operated pump or, in the case where the product is pressurized in the container, a manually operated valve.

In particular, a manually operated pump conventionally comprises a body in which there is arranged a means for pressurizing the product to be dispensed. According to one embodiment in particular, the pump is of the airless type, i.e. without air intake to compensate for the amount of product that has been dispensed, so as to prevent the passage of contaminated product into the conditioned product.

It is known that the dispensing system comprises means for assembling the sampling device in the bottle body 1, such as, for example, a screw plug in which said sampling device is mounted and which is to be screwed onto the neck of said body, to arrange said sampling device within said neck. Further, the dispensing system comprises means for sampling the product into the container, wherein said means comprises, for example, a dip tube mounted at a lower end of the sampling device, or a piston, which is slidably mounted within said container in order to push the product to said sampling device.

To enable the product to be dispensed, the sampling device is provided with a pressure feed tube of said product, which can notably extend axially from the upper end of the body of said sampling device. Furthermore, the dispensing system comprises an actuating assembly for actuating said system, wherein said actuating assembly notably comprises a press button 2 that is mounted on the feed tube of the sampling device to allow the product to be dispensed under pressure with the axial displacement of said press button.

With respect to the figures, the actuating assembly comprises a shoulder 3, which comprises a means for mounting it to the sampling device, such that the feed tube of said device extends out of said shoulder, so that the press button 2 may be mounted to said feed tube.

In particular, the shoulder 3 comprises a central hole 4 in which a plug for assembling the sampling device on the bottle 1 should be disposed in the serrated contact, so that said shoulder may be notably fixed in rotation with respect to the sampling device.

As shown in the figures, the bottle body has a rectangular geometry with the elongated sides 1*a* and lateral faces, and the shoulder 3 has a similar rectangular geometry with the elongate panels 3*a* and the side panels 3*b*. For aesthetic reasons, it is particularly advantageous to mount the sampling device on the bottle 1 so that the elongate panels 3*a* of the shoulder 3 are parallel to the elongated sides 1*a* of the bottle 1. However, such an aesthetic arrangement is relatively difficult to obtain when the sampling device is assembled by being screwed on the bottle 1.

To solve this problem, the central hole 4 comprises vertical grooves 5 which are disposed on at least a portion of the inner wall, wherein said vertical grooves are arranged to engage in serrated coupling with the vertical serrations that can be disposed in the mounting plug of the sampling device during engagement of said plug within said central hole.

Thus, for assembling the shoulder 3 in the bottle 1, the sampling device may first be mounted to said vial by screwing its mounting plug. Thereafter, the shoulder 3 may be disposed relative to the bottle 1 to provide an aesthetic orientation as previously described. Finally, the shoulder 3 may be mounted on the plug screwed by the serrated coupling between the grooves 5 with some of the serrations of said plug.

The press button 2 comprises an inner actuator 6, which has an upstream spout 6*a* in which a lower end thereof is to be mounted in a sealed manner in the feed tube of the sampling device. Further, the press button 2 comprises an outer cover 7 comprising a peripheral skirt 7*a* surrounding the inner actuator 6, such as an upper plate 7*b* which has an upper region for driving the dispensing system, notably allowing the user to press with the finger said upper region to axially move said press button.

The inner actuator 6 further comprises a downstream spout 6*b* which is in communication with the upstream spout 6*a* and terminates in an outlet 8 to dispense the product under pressure. To dispense a liquid product, an insert 9 may be engaged within the outlet 8 to produce a spray.

With respect to the figures, the upstream spout 6*a* extends longitudinally and the downstream spout 6*b* extends laterally. The orientation is taken with respect to the direction in which the press button 2 is actuated.

This modality allows a lateral dispensing of the product under pressure with respect to the outer cover 7 of the press button 2. Regarding the figures, the peripheral skirt 7*a* of the outer cover 7 has a rectangular geometry and the downstream spout 6*b* is intended to dispense product through the elongate surface of said geometry opposite the feed tube.

In particular, the inner actuator 6 may be made in one piece, with the downstream spout 6*b* being connected in product communication with the upstream spout 6*a*. Alternatively, the upstream spout 6*a* and downstream spout 6*b* may be formed separately, for example by molding, and then connected together in product communication to form the inner actuator 6.

Thus, by mounting the lower end of the upstream spout 6*a* in the feeding tube of the sampling device, dispensing of the product under pressure is obtained by manually pressing the outer cover 7 to actuate the displacement of said feed tube so as to direct the product under pressure from said feed tube to the dispensing outlet 8 of the downstream spout 6*b*.

In particular, a dispensing hole 10 is formed in the peripheral skirt 7*a* of the outer cover 7, so that, in order to allow the product to be dispensed, the outer cover 7 is mounted on the inner actuator 6 in a actuating position in which the dispensing hole 10 is disposed opposite the outlet 8 to allow said dispensing through said hole, and wherein the press button 2 is axially displaceable with respect to the shoulder 3 in a dispensing/aspiration stroke.

With reference to FIGS. 4 and 5, the peripheral skirt 7*a* comprises two longitudinal panels 11*a*, 11*b* which are arranged to extend along at least a portion of the length of the bottle 1. In addition, the dispensing hole 10 is formed in one of said longitudinal panels 11*a*, which must be disposed opposite the outlet 8 when the outer cover 7 is mounted in the actuating position, to allow the product to be dispensed through said dispensing hole.

In particular, the longitudinal panels 11*a*, 11*b* of the outer cover 7 should be arranged opposite to a respective elongated side 1*a* of the bottle 1, so as to give the bottle 1 a relatively aesthetic appearance. Further, the bottle 1 comprises two rectangular molds 12 which are respectively formed on each of the elongated sides 1*a* and wherein a longitudinal panel 11*a*, 11*b* is disposed when the outer cover 7 is mounted on the inner driver 6, so that said panels do not generate any odd looking thickness on the elongate sides 1*a* of the bottle 1.

Advantageously, each mold 12 has a width, which is substantially equal to the width of the longitudinal panels 11*a*, 11*b*, so that said panels can be guided translation-wise within said molds during the axial displacement of the press button 2 in its dispensing stroke/aspiration. Furthermore, at least one longitudinal panel 11*a*, 11*b* may comprise a friction means which must interact with an outer periphery of the bottle 1, especially with an inner surface 12*a* formed within the mold 12 in which said panel is arranged, to guide the axial displacement of the press button 2.

Figure 1A:
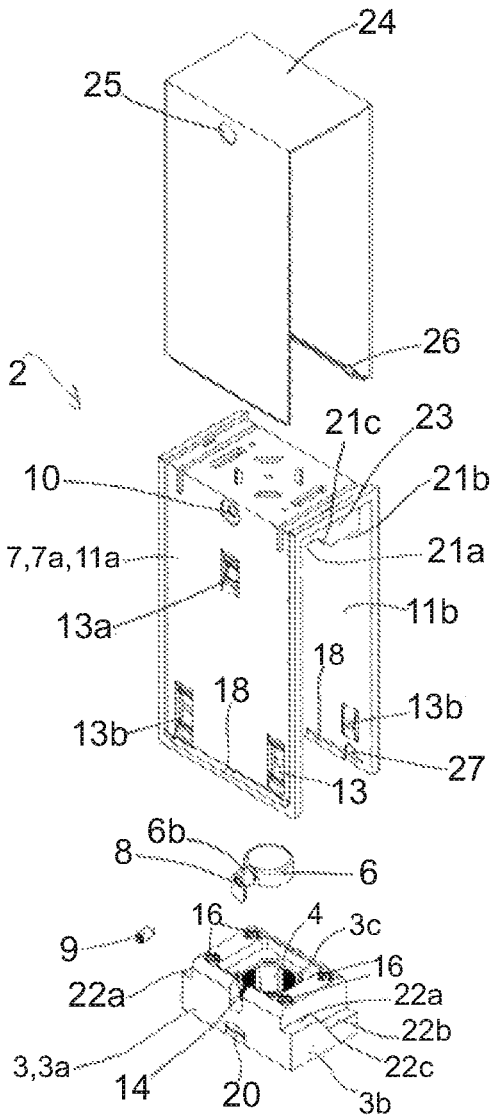
FIG. 1 illustrates an actuating assembly according to one embodiment of the invention, respectively, in an exploded view (FIG. 1*a*) and in a longitudinal section of a side view (FIG. 1*b*).
Figure 1B:
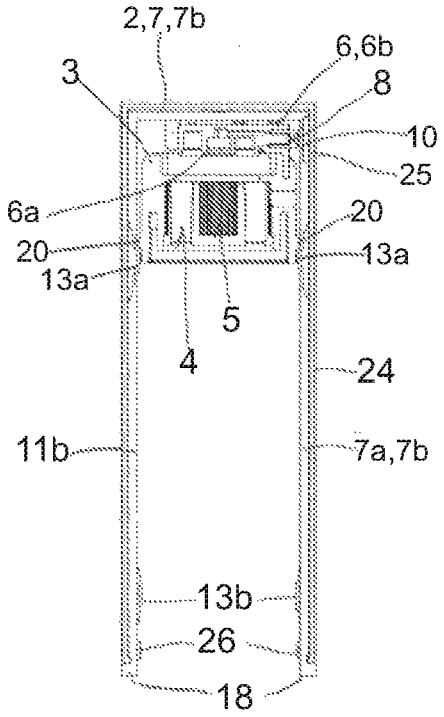
Figure 3:
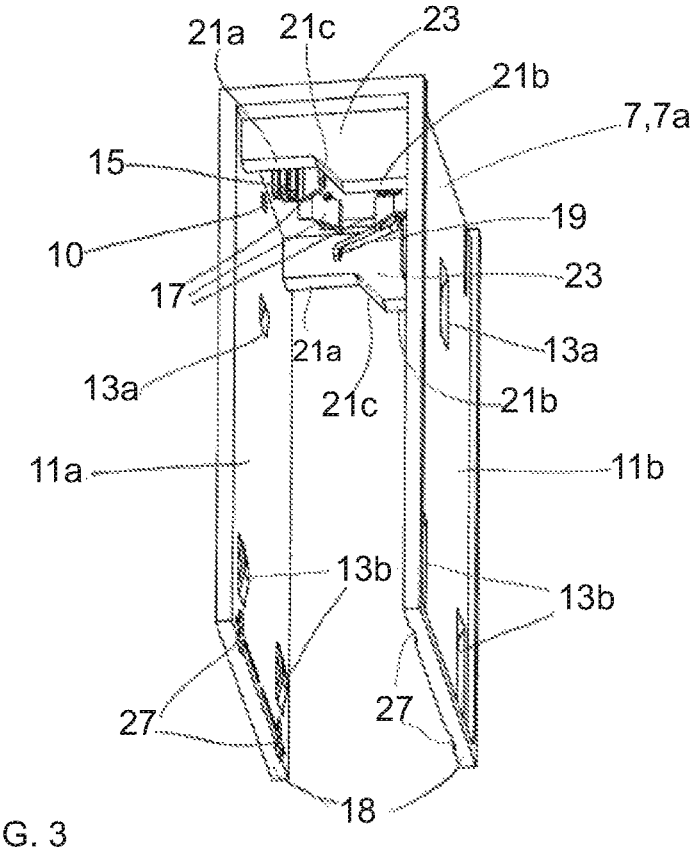
FIG. 3 illustrates in perspective and side view the outer cover of the actuating assembly of FIG. 1.

Referring to FIGS. 1 and 3, each longitudinal panel 11*a*, 11*b* comprises friction protrusions extending from their inner surfaces, especially a centered upper protrusion 13*a* and two lower protrusions 13*b*, wherein said protrusions interact respectively with the inner surface 12*a* of a mold 12 during axial displacement of the press button 2 to guide said axial displacement.

With respect to the figures, the longitudinal panels 11*a*, 11*b* of the outer cover 7 are also arranged opposite to a respective elongated panel 3*a* of the shoulder 3 when the outer cover 7 is mounted on the inner actuator 6. In particular, the shoulder 3 comprises a longitudinal notch 14, which is formed in the center of one of its elongate panels 3*a*, wherein the downstream spout 6*b* is to be axially slid within said notch during axial displacement of the press button 2 in the dispensing/aspiration course.

The press button 2 may also comprise an alignment means 15, which is intended to cooperate with the complementary alignment means 16 formed in the shoulder 3 to ensure alignment of said press button with the feed tube during axial displacement of said press button. Thus, the feed tube can be displaced collinearly with the press button 2 and with the axis of the sampling device, which not only ensures the reliability of the product communication between said feed tube and the inner actuator 6, but also ensures the correct actuation of the sampling device while preventing any damages to said device which may result from misalignment of the feed tube with said device.

In particular, the outer cover 7 may comprise at least one pair of axial pins 15 extending under the upper plate 7*b* and which are arranged symmetrically so as to provide the alignment means which are balanced with respect to the axial displacement of the press button 2. Furthermore, the shoulder 3 may comprise at least a pair of guide recesses 16, which are arranged symmetrically on its upper surface 3*c* in the same manner as the pair of pins 15, wherein said pins are intended to be slidably received respectively in a guide recess 16 during axial displacement of the press button 2 relative to said shoulder.

Figure 2:
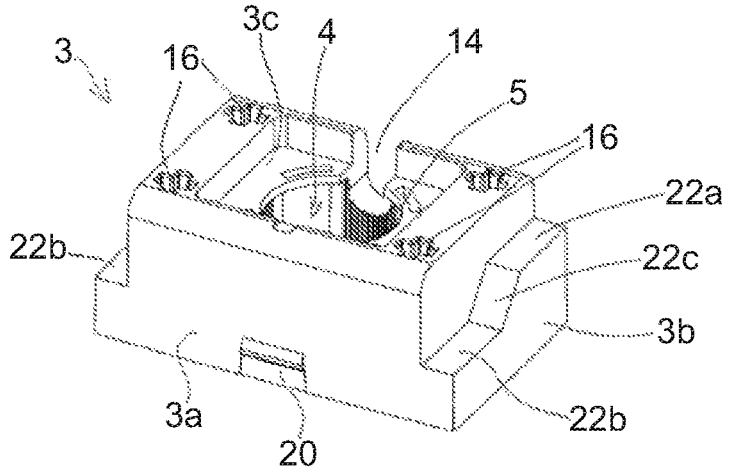
FIG. 2 illustrates a perspective view of the shoulder of the actuating assembly of FIG. 1.

Referring to FIGS. 2 and 3, the outer cover 7 notably comprises two axial pins 15, which are arranged diagonally under the upper plate 7*b*, and the shoulder 3 comprises four guide recesses 16 which are respectively arranged in a corner of its upper rectangular surface 3*c*.

The actuating assembly may also comprise a means for forming an axial retainer at the end of the axial displacement of the press button 2 in its dispensing stroke. In particular, the outer cover 7 may comprise at least one pair of axial pins 17 extending under the upper plate 7*b* and which are arranged symmetrically so as to provide the axial retention means which are balanced with respect to the axial displacement of the press button 2. In addition, the axial flaps 17 may be provided to touch the upper surface 3*c* of the shoulder 3 at the end of the axial displacement of the press button 2 in its dispensing stroke.

Referring to FIG. 3, the outer cover 7 comprises four axial flaps 17 which are angularly distributed under the top plate 7*b*, notably in a manner such that a housing is formed in which the inner actuator 6 can be received with the assembly of the outer cover 7 thereon, to ensure radial maintenance of said outer cover on said inner actuator.

Further, each mold 12 of the bottle 1 comprises a lower radial wall 12*b* wherein the lower end 18 of a longitudinal panel 11*a*, 11*b* axially touches at the end of the axial displacement of the press button 2 in its dispensing stroke.

Once a dose of the product has been dispensed, the user can release his finger from the upper zone, so that the press button 2 can be moved axially in its suction stroke. To do this, the sampling device conventionally comprises a resilient return means, for example in the form of a spring, wherein said means allows an upper axial displacement of the feed tube and then of the press button 2 to an upper resting position, the refilling of said sampling device with the sampled product into the dispensable container with a subsequent actuation.

However, because of the friction contacts between the protrusions 13*a*, 13*b* of the outer cover 7 and the bottle 1 during the displacements of the press button 2, the resilient return means of the sampling device may not be sufficient to ensure the appropriate displacement of said press button on its suction stroke.

Referring to FIG. 3, to assist the elastic return means of the sampling device, the outer cover 7 comprises at least one spring blade 19, which is arranged to allow axial displacement of the press button 2 in its suction stroke, notably by the elastic support on the upper surface 3*c* of the shoulder 3. As a variant, the shoulder 3 may also comprise at least one spring blade.

The outer cover 7 and the shoulder 3 may also comprise reciprocating pressure means for securing the actuating assembly when the outer cover 7 is mounted on the inner actuator 6, notably to prevent separation of said outer cover from said inner actuator, at the end of the displacement of the press button 2 in its suction stroke. Moreover, such reciprocating pressure means may be arranged to allow the axial displacement of the press button 2 relative to the shoulder 3 when the outer cover 7 is mounted in the actuating position, so as to enable the system to be activated to dispense the product under pressure.

Referring to FIGS. 1 to 3, the shoulder 3 comprises two pressure projections 20 which are respectively formed in the center of an elongate panel 3*a*, wherein the centered upper protrusions 13*a* of each longitudinal panel 11*a*, 11*b* are respectively engaged under a projection when the outer cover 7 is mounted to the inner actuator 6, while allowing axial displacement of said outer cover, and then of the press button 2, relative to the shoulder 3.

In particular, the pressure projections 20 and the upper protrusions 13*a* are arranged so that the upper protrusions 13*a* touch axially under the respective pressure projection 20 at the end of the axial displacement of the press button 2 in its suction stroke, so as to prevent the separation of the outer cover 7 from the inner actuator 6 at the end of the press button 2 shift in its suction stroke.

When the bottle 1 is not used, it is desirable to prevent axial displacement of the press button 2 so as to avoid any accidental dispensing of the product through the outlet 8.

To do so, the outer cover 7 is reversibly mounted on the inner actuator 6 from the actuating position to an inactive position (shown in FIG. 6), wherein the geometric means formed in the outer cover 7 are arranged to cooperate with the complementary geometric means formed in the shoulder 3, so as to prevent axial displacement of the push button 2.

In particular, the outer cover 7 and the shoulder 3 comprise respectively inactive support surfaces 21*b*, 22*a* which are to be arranged axially opposite each other when the outer cover 7 is mounted in the inactive position and touch one against the other to prevent axial displacement of the press button 2.

Moreover, the outer cover 7 and/or the shoulder 3 may comprise actuating support surfaces 21*a*, 22*b* which are to be arranged axially opposite the inactive support surfaces 22*a*, 21*b* of the shoulder 3 and/or the outer cover 7 when the outer cover 7 is mounted in the actuating position to allow the axial displacement of the push button 2, wherein the inactive support surfaces 21*b*, 22*a* must touch the actuating support surfaces 21*a*, 22*b* at the end of the press button 2 displacement in its dispensing stroke.

Thus, when the outer cover 7 is mounted in the drive position, the geometrical means 21*a*, 21*b*, 22*a*, 22*b* may play a role in the displacement of the press button in its dispensing stroke, in particular by forming an axial retention to limit the said dispensing stroke.

In particular, the geometric means 21*a*, 21*b*, 22*a*, 22*b* may be arranged to define two angular positions corresponding respectively to the actuating position and to the inactive position, wherein the outer cover 7 is reversibly mounted from one of said positions to the other with relative rotation between said angular positions of said outer cover relative to the shoulder 3. In this way, the reversible mounting of the outer cover 7 can be performed by the user in an easy and relatively intuitive manner.

Advantageously, the respective geometric means of the outer cover 7 and the shoulder 3 are arranged symmetrically, especially on each side side of said outer cover and said shoulder, so as to provide the means which are correctly balanced with respect to the axial direction of the press button 2.

With respect to the figures, the peripheral skirt 7*a* of the outer cover 7 comprises two side panels 23 wherein the lower ends thereof have a stepped geometry with an upper support surface 21*a* and a lower support surface 21*b*. Likewise, the shoulder 3 comprises two side panels 3*b* wherein the upper ends thereof have a similar geometry 22*a*, 22*b*. Moreover, each stepped geometry comprises an inclined surface 21*c*, 22*c* extending between the upper support surface 21*a*, 22*a* and the lower support surface 21*b*, 22*b*.

In particular, the respective stepped geometries of the outer cover 7 and the shoulder 3 are arranged so that each lower support surface 21*b* of the outer cover 7 must be disposed axially opposite a lower support surface 22*b* of the shoulder 3 when said outer cover is mounted in the actuating position (FIGS. 4 and 5), and to an upper support surface 22*a* of said shoulder when said outer cover is mounted in the inactive position (FIG. 6).

To mount the outer cover 7 from the actuating position to the inactive position, the user first removes said outer cover from the inner actuator 6 by pulling said outer cover up in the axial direction, and therefor until the uncoupling of the upper protrusions 13*a* from the outer cover 7 on the pressure projections 20 of the shoulder 3.

Thereafter, the user simply rotates the outer cover 7 relative to the shoulder 3 around the axial direction at an angle of 180°, so as to arrange the lower support surfaces 21*b* of the outer cover 7 axially opposite the upper support surfaces 22*a* of the shoulder 3, and finally mounts the outer cover 7 on the inner actuator again, until the recoupling of the upper protrusions 13*a* of said outer cover under the pressure projections 20 of said shoulder.

In particular, in the inactive position, the dispensing hole 10 of the outer cover 7 is disposed away from the outlet 8 of the inner actuator 6, wherein said outlet is notably covered by the other longitudinal panel 11*b* of said outer cover, which does not comprise a dispensing hole. Thus, the outlet 8 can be substantially isolated from the external air.

The outer cover 7 can be manufactured in different ways. In particular, the outer cover 7 can be manufactured by molding a plastic material, which is an easy and fast process and allows for the different technical means 13*a*, 13*b*, 15, 17, 19, which have been previously mentioned, to be easily carried out, notably to ensure axial orientation, alignment and/or assembly of said outer cover.

However, such a solution can cause aesthetic problems, since the technical means 13*a*, 13*b*, 15, 17, 19 are formed on the inner surfaces of the peripheral skirt 7*a* and the upper plate 7*b* by means of a plastic mass, which may cause bad looking scratches on the outer surfaces of said peripheral skirt and said upper plate.

To solve this problem, the press button 2 may also comprise a trim cover 24, which is to be mounted on the outer cover 7, so that said trim cover masks the bad looking scratches and enhances the overall aesthetic appearance of the bottle 1.

With respect to the figures, the trim cover 24 comprises a hole 25 which is to be disposed opposite the dispensing hole 10 and mounting on the outer cover 7. Moreover, the trim cover 24 comprises a fastening means, for example, the flaps 26 formed at the lower end of the longitudinal panels, which are to be coupled with the reciprocal fastening means formed in the outer cover 7, for example, the securing means 27 formed in the lower ends 18 of the longitudinal panels 11*a*, 11*b*.

In addition, the trim cover 24 may comprise decorations, which may be accomplished by means of printing, embossing or molding, on the outer surface of the longitudinal panels and/or upper plate.

The invention claimed is:

1. An actuating assembly for a system for dispensing a product under pressure, wherein said assembly comprising a shoulder (3) configured to be mounted on a device for sampling the product under pressure, wherein said assembly further comprises a press button (2) which comprises an inner actuator (6) having an upstream spout (6*a*) wherein a lower end thereof is to be mounted in a feed tube of the sampling device, wherein said inner actuator comprises a downstream spout (6*b*) which is in communication with said upstream spout and terminates in an outlet (8) for dispensing the product under pressure, wherein said press button comprises an outer cover (7) with a peripheral skirt (7*a*) in which a dispensing hole (10) is formed, wherein said outer cover is mounted on said inner actuator in an actuating position in which the dispensing hole (10) is arranged opposite the outlet (8) to allow the product to be dispensed through said dispensing hole and wherein the press button (2) is axially displaceable relative to the shoulder (3) in a dispensing stroke and in an aspiration stroke, wherein said assembly is characterized in that the outer cover (7) is reversibly mounted on the inner actuator (6) from the actuating position to an inactive position, wherein geometric means (21*a*, 21*b*) are formed in the outer cover (7) and are arranged to cooperate with complementary geometric means (22*a*, 22*b*) formed in the shoulder (3) so as to prevent axial displacement of the press button (2), and wherein the skirt (7*a*) comprises two longitudinal panels (11*a*, 11*b*) which are arranged to extend at least along a part of the length of a bottle (1) on which the dispensing system must be mounted.

2. The actuating assembly of claim 1, wherein the geometric means (21*a*, 21*b*, 22*a*, 22*b*) are arranged to define two angular positions corresponding respectively to the actuating position and to the inactive position, and wherein the outer cover (7) is reversibly mounted from one of said positions to the other with relative rotation between said angular positions of said outer cover relative to the shoulder (3).

3. The actuating assembly of claim 1, wherein the outer cover (7) and the shoulder (3) comprise respectively inactive support surfaces (21*b*, 22*a*) which are to be arranged axially opposite to each other when the outer cover (7) is mounted in the inactive position and touch one against the other to prevent axial displacement of the press button (2).

4. The actuating assembly of claim 3, wherein the outer cover (7) and/or the shoulder (3) comprise actuating support surfaces (21*a*, 22*b*) which are to be arranged axially opposite the inactive support surface (22*a*, 21*b*) of the shoulder (3) and/or the outer cover (7) when said outer cover is mounted in the actuating position to allow axial displacement of the press button (2).

5. The actuating assembly of claim 4, wherein the inactive support surface (21*b*, 22*a*) must touch the actuating support surface (21*a*, 22*b*) at the end of the displacement of the press button (2) in the dispensing stroke.

6. The actuating assembly of claim 4, wherein each of the outer cover (7) and the shoulder (3) comprises two side panels (3*b*, 23) each of which has a stepped geometry with upper support surfaces (21*a*, 22*a*) and lower support surfaces (21*b*, 22*b*), and wherein one of the lower support surfaces (21*b*) of the outer cover (7) must be disposed axially opposite another lower support surface (22*b*) and an upper support surface (22*a*) of the shoulder (3), respectively, when the outer cover (7) is mounted in the actuating position or in the inactive position.

7. The actuating assembly of claim 6, wherein each stepped geometry comprises an inclined surface (21*c*, 22*c*) extending between the upper support surface (21*a*, 22*a*) and the lower support surface (21*b*, 22*b*).

8. The actuating assembly according to claim 1, wherein the outer cover (7) and/or shoulder (3) comprise at least one spring blade (19) disposed to assist in the axial displacement of the press button in the aspiration stroke.

9. The actuating assembly according to claim 1, further comprising means (17, 18) to form an axial retention at the end of the axial displacement of the press button (2) in the dispensing stroke.

10. The actuating assembly according to claim 9, wherein the outer cover (7) comprises an upper plate (7*b*) under which at least one pair of axial flaps (17) is symmetrically disposed, and wherein said flaps are to touch an upper surface (3*c*) of the shoulder (3) at the end of the axial displacement of the press button (2) in the dispensing stroke.

11. The actuating assembly according to claim 1, wherein the dispensing hole (10) is formed in one of the longitudinal panels (11*a*), wherein said longitudinal panel must be disposed opposite the outlet (8) of the inner actuator (6) when the outer cover (7) is mounted in the actuating position.

12. The actuating assembly according to claim 1, wherein at least one longitudinal panel (11*a*, 11*b*) comprises a friction means (13*a*, 13*b*) for interacting with an outer periphery (12*a*) of the bottle (1) to guide the axial displacement of the press button (2) in the dispensing stroke and the aspiration stroke.

13. The actuating assembly according to claim 1, wherein the press button (2) comprises aligning means (15) for cooperating with complementary aligning means (16) formed in the shoulder (3) to ensure alignment of said press button with the feed tube during axial displacement of said press button.

14. The actuating assembly according to claim 13, wherein the outer cover (7) comprises an upper plate (7*b*) under which at least one pair of axial pins (15) are symmetrically disposed, and wherein said pins must be slidably received respectively in a guide recess (16) formed in an upper surface (3*c*) of the shoulder (3) during axial displacement of the press button (2) with respect to the shoulder (3).

15. The actuating assembly according to claim 1, wherein the outer cover (7) and the shoulder (3) comprise reciprocating pressure means (13*a*, 20), and wherein said pressure means are arranged to allow axial displacement of the press button (2) relative to the shoulder (3) when the outer cover (7) is mounted in the actuating position.

16. A system for dispensing a product under pressure, comprising a sampling device provided with a feed tube under pressure of the product, wherein said sampling device is configured as the actuating assembly according to claim 1, and wherein the shoulder (3) is mounted to the sampling device in such a way that the feed tube extends out of said shoulder, the lower end of the upstream spout (6*a*) of the press button (2) is mounted on said feed tube to allow dispensing said product under pressure.

17. A dispensing system according to claim 16, wherein the shoulder (3) comprises a central hole (4) in which a plug for assembling the sampling device in the bottle (1) should be arranged in serrated contact.

18. A bottle (1) for dispensing a product under pressure, comprising a body in which the bottle intended to contain said product is formed, and wherein said body is also equipped with the dispensing system as defined in claim 16, to allow dispensing said product under pressure.

19. An actuating assembly for a system for dispensing a product under pressure, wherein said assembly comprising a shoulder (3) configured to be mounted on a device for sampling the product under pressure, wherein said assembly further comprises a press button (2) which comprises an inner actuator (6) having an upstream spout (6*a*) wherein a lower end thereof is to be mounted in a feed tube of the sampling device, wherein said inner actuator comprises a downstream spout (6*b*) which is in communication with said upstream spout and terminates in an outlet (8) for dispensing the product under pressure, wherein said press button comprises an outer cover (7) with a peripheral skirt (7*a*) in which a dispensing hole (10) is formed, wherein said outer cover is mounted on said inner actuator in an actuating position in which the dispensing hole (10) is arranged opposite the outlet (8) to allow the product to be dispensed through said dispensing hole and wherein the press button (2) is axially displaceable relative to the shoulder (3) in a dispensing stroke and in an aspiration stroke, wherein the outer cover (7) is reversibly mounted on the inner actuator (6) from the actuating position to an inactive position, wherein geometric means (21*a*, 21*b*) formed in the outer cover (7) are arranged to cooperate with complementary geometric means (22*a*, 22*b*) formed in the shoulder (3) so as to prevent axial displacement of the press button (2), wherein the actuating assembly is configured to form an axial retention at the end of the axial displacement of the press button (2) in the dispensing stroke, wherein the outer cover (7) comprises an upper plate (7*b*) under which at least one pair of axial flaps (17) is symmetrically disposed, wherein said flaps are to touch an upper surface (3*c*) of the shoulder (3) at the end of the axial displacement of the press button (2) in the dispensing stroke.

20. An actuating assembly for a system for dispensing a product under pressure, wherein said assembly comprising a shoulder (3) configured to be mounted on a device for sampling the product under pressure, wherein said assembly further comprises a press button (2) which comprises an inner actuator (6) having an upstream spout (6*a*) wherein a lower end thereof is to be mounted in a feed tube of the sampling device, wherein said inner actuator comprises a downstream spout (6*b*) which is in communication with said upstream spout and terminates in an outlet (8) for dispensing the product under pressure, wherein said press button comprises an outer cover (7) with a peripheral skirt (7*a*) in which a dispensing hole (10) is formed, wherein said outer cover is mounted on said inner actuator in an actuating position in which the dispensing hole (10) is arranged opposite the outlet (8) to allow the product to be dispensed through said dispensing hole and wherein the press button (2) is axially displaceable relative to the shoulder (3) in a dispensing stroke and in an aspiration stroke, wherein the outer cover (7) is reversibly mounted on the inner actuator (6) from the actuating position to an inactive position, wherein geometric means (21*a*, 21*b*) formed in the outer cover (7) are arranged to cooperate with complementary geometric means (22*a*, 22*b*) formed in the shoulder (3) so as to prevent axial displacement of the press button (2), wherein the press button (2) comprises aligning means (15) for cooperating with complementary aligning means (16) formed in the shoulder (3) to ensure alignment of said press button with the feed tube during axial displacement of said press button, wherein the outer cover (7) comprises an upper plate (7*b*) under which at least one pair of axial pins (15) are symmetrically disposed, wherein said pins must be slidably received respectively in a guide recess (16) formed in an upper surface (3*c*) of the shoulder (3) during axial displacement of the press button (2) with respect to the shoulder (3).

* * * * *